US009240195B2

(12) United States Patent
Zhao et al.

(10) Patent No.: US 9,240,195 B2
(45) Date of Patent: Jan. 19, 2016

(54) SPEECH ENHANCING METHOD AND DEVICE, AND DENOISING COMMUNICATION HEADPHONE ENHANCING METHOD AND DEVICE, AND DENOISING COMMUNICATION HEADPHONES

(75) Inventors: Jian Zhao, Weifang (CN); Song Liu, Weifang (CN); Bo Li, Weifang (CN); Yang Hua, Weifang (CN)

(73) Assignee: GOERTEK INC., Weifang (CN)

( * ) Notice: Subject to any disclaimer, the term of this patent is extended or adjusted under 35 U.S.C. 154(b) by 571 days.

(21) Appl. No.: 13/637,715

(22) PCT Filed: Nov. 25, 2011

(86) PCT No.: PCT/CN2011/082993

§ 371 (c)(1),
(2), (4) Date: Sep. 27, 2012

(87) PCT Pub. No.: WO2012/069020

PCT Pub. Date: May 31, 2012

(65) Prior Publication Data

US 2013/0024194 A1 Jan. 24, 2013

(30) Foreign Application Priority Data

Nov. 25, 2010 (CN) ..... 2010 1 0560256

(51) Int. Cl.
*G10L 21/00* (2013.01)
*G10L 21/0208* (2013.01)
(Continued)

(52) U.S. Cl.
CPC ..... *G10L 21/0208* (2013.01); *H04R 3/005* (2013.01); *G10L 2021/02165* (2013.01); *H04R 1/083* (2013.01); *H04R 2201/107* (2013.01); *H04R 2410/05* (2013.01)

(58) Field of Classification Search
CPC ..... G10L 2021/02165; H04R 1/14; H04R 2460/13
See application file for complete search history.

(56) References Cited

U.S. PATENT DOCUMENTS 5,673,325 A * 9/1997 Andrea et al. ..... 381/92
6,847,723 B1 1/2005 Kiuchi et al.

(Continued)

FOREIGN PATENT DOCUMENTS

CN 1172422 2/1998
CN 1172422 A 2/1998

(Continued)

*Primary Examiner* — Matthew Baker
(74) *Attorney, Agent, or Firm* — Troutman Sanders LLP

(57) ABSTRACT

The present invention discloses a speech enhancing method, a speech enhancing device and a denoising communication headphone. In the solutions of the present invention, a first sound signal that comprises a user's speech signal transmitted through coupling vibration and an ambient noise signal transmitted through the air and a second sound signal that is mainly an ambient noise signal transmitted through the air are picked up by a primary vibration microphone and a secondary vibration microphone, respectively, that have a specific relative positional relationship therebetween, and the ambient noise signals picked up by the two vibration microphones are correlated with each other; a control parameter used to control an updating speed of an adaptive filter is determined according to the first sound signal and the second sound signal; the first sound signal is denoised and filtered according to the second sound signal and the control parameter; and the denoised and filtered speech signal is further denoised and speech high-frequency enhancement is performed thereon. The technical solutions of the present invention can effectively improve the signal to noise ratio (SNR) and the quality of speech in an environment of highly intense noises.

10 Claims, 4 Drawing Sheets

(51) Int. Cl.

| | |
|---|---|
| ***H04R 3/00*** | (2006.01) |
| *G10L 21/0216* | (2013.01) |
| *H04R 1/08* | (2006.01) |

(56) References Cited

U.S. PATENT DOCUMENTS

| | | | | |
|---|---|---|---|---|
| 7,246,058 | B2 * | 7/2007 | Burnett | 704/226 |
| 7,406,303 | B2 * | 7/2008 | Deng et al. | 455/260 |
| 7,499,686 | B2 * | 3/2009 | Sinclair et al. | 455/223 |
| 7,983,720 | B2 * | 7/2011 | Chen | 455/575.1 |
| 2002/0039425 | A1 * | 4/2002 | Burnett et al. | 381/94.7 |
| 2002/0198705 | A1 * | 12/2002 | Burnett | 704/214 |
| 2003/0061032 | A1 * | 3/2003 | Gonopolskiy | 704/200.1 |
| 2003/0108214 | A1 * | 6/2003 | Brennan et al. | 381/94.7 |
| 2003/0128848 | A1 * | 7/2003 | Burnett | 381/71.8 |
| 2003/0147538 | A1 * | 8/2003 | Elko | 381/92 |
| 2003/0179888 | A1 * | 9/2003 | Burnett et al. | 381/71.8 |
| 2003/0228023 | A1 * | 12/2003 | Burnett et al. | 381/92 |
| 2004/0133421 | A1 * | 7/2004 | Burnett et al. | 704/215 |
| 2004/0249633 | A1 * | 12/2004 | Asseily et al. | 704/200 |
| 2005/0114124 | A1 * | 5/2005 | Liu et al. | 704/228 |
| 2008/0159559 | A1 * | 7/2008 | Akagi et al. | 381/92 |
| 2009/0003622 | A1 * | 1/2009 | Burnett | 381/92 |
| 2009/0220107 | A1 * | 9/2009 | Every et al. | 381/94.7 |
| 2009/0238377 | A1 * | 9/2009 | Ramakrishnan et al. | 381/92 |
| 2010/0128881 | A1 * | 5/2010 | Petit et al. | 381/56 |
| 2010/0158269 | A1 * | 6/2010 | Zhang | 381/94.2 |
| 2010/0278352 | A1 * | 11/2010 | Petit et al. | 381/71.1 |
| 2011/0010172 | A1 * | 1/2011 | Konchitsky | 704/233 |
| 2011/0026722 | A1 * | 2/2011 | Jing et al. | 381/71.1 |
| 2011/0051950 | A1 * | 3/2011 | Burnett | 381/92 |
| 2011/0135106 | A1 * | 6/2011 | Yehuday et al. | 381/71.6 |
| 2011/0216917 | A1 * | 9/2011 | Ganeshkumar et al. | 381/86 |
| 2012/0057717 | A1 * | 3/2012 | Nystrom | 381/71.6 |
| 2013/0073283 | A1 * | 3/2013 | Yamabe | 704/226 |
| 2013/0156208 | A1 * | 6/2013 | Banba et al. | 381/60 |

FOREIGN PATENT DOCUMENTS

| | | | |
|---|---|---|---|
| CN | 1622200 | | 6/2005 |
| CN | 1622200 | A | 6/2005 |
| CN | 101192411 | | 6/2008 |
| CN | 101192411 | A | 6/2008 |
| CN | 101247669 | | 8/2008 |
| CN | 101247669 | A | 8/2008 |

* cited by examiner

SPEECH ENHANCING METHOD AND DEVICE, AND DENOISING COMMUNICATION HEADPHONE ENHANCING METHOD AND DEVICE, AND DENOISING COMMUNICATION HEADPHONES

TECHNICAL FIELD

The present invention relates to the field of speech signal processing technologies, and more particularly, to a speech enhancing method and a speech enhancing device for a transmitter terminal, and a denoising communication headphone.

DESCRIPTION OF RELATED ART

With the progress of technologies and improvement of social informatization, the communication among people also becomes ever-increasingly efficient and convenient, and wide application of various communication apparatuses and technologies provides great convenience for people's life and increases the working efficiency. Noise problems generated with the development of the society, however, have a serious influence on definition and intelligibility of communication speech. When the intensity of noises increases to a certain level, not only communication cannot continue, but also people's hearing and physical and psychological health will be damaged. Particularly in some places such as airports, stations and large industrial plants, requirements on realtime of the communication and definition and intelligibility of the communication speech are particularly high. However, in these special places, the intensity of the ambient noises often reaches above 100 dB. When a speech is transmitted under such situations of the extreme noises, the speech signal received by a remote user will be completely submerged by the ambient noises and the remote user cannot obtain any useful information at all. Therefore, it is necessary to adopt an effective speech enhancing method at a transmitter terminal of a communication apparatus to increase the signal to noise ratio (SNR) of the speech of the transmitter terminal.

There are two kinds of speech enhancing methods for a transmitter terminal of a communication apparatus that are commonly used presently. One kind of the speech enhancing method is to use a single or a plurality of typical microphone(s) to pick up a signal and then to enhance the speech through acoustic signal processing. The other kind of speech enhancing method is to use special acoustic microphones (e.g., close-talking microphones and vibration microphones) to effectively pick up a speech signal and suppress noises.

The speech enhancing technology using a single microphone is usually called the single-channel spectral subtraction speech enhancing technology (see China Patent Application Publication No. CN1684143A, CN101477800A). This technology usually estimates energy of noises in the current speech by analyzing historical data and then eliminates the noises in the speech through frequency-spectrum subtraction so as to enhance the speech. The speech enhancing technology using a microphone array consisting of two or more microphones (see China Patent Application Publication No. CN101466055A, CN1967158A) usually uses a signal received by one microphone as a reference signal, estimates and offsets in real time through adaptive filtering the noise components in a signal picked up by another microphone and maintains the speech components, thereby enhancing the speech. The performance of the speech enhancing methods using a single or a plurality of typical microphones greatly relies on detection and determination of speech statuses; otherwise, not only the noises cannot be correctly eliminated, but also severe damage will be caused to the speech signal. In an environment of low noises, detection and determination of the speech statuses are feasible and accurate. However, in an environment of intense noises, the speech signal will be completely submerged by the noises. In such a case of a particularly low SNR, the speech enhancing technologies using one or more typical microphone(s) cannot achieve a desired effect or cannot be used at all.

The other kind of speech enhancing method is to use some special acoustic microphones (e.g., close-talking microphones and vibration microphones) to increase the SNR of the picked-up speech in environments of noises so as to enhance the speech. A close-talking microphone, which is also called a denoising microphone, is designed according to the differential pressure principle, has directivity and "close-talking effect", and can reduce noises and particularly can reduce far-field low-frequency noises by about 15 dB. Currently, ordinary telephone headsets and some headphones in the field of professional communication mostly use close-talking microphones. A vibration microphone must be well coupled with a vibration plane to pick up a useful signal, and can reduce a noise signal transmitted through the air by 20 dB to 30 dB. However, the close-talking microphone is limited in noise reduction and cannot effectively suppress wind noises. Although the vibration microphone (see China Utility Model Patent No. CN2810077Y) can reduce noises (including wind noises) by 20 dB to 30 dB within a full frequency band, the vibration microphone has a poor frequency response and cannot effectively pick up high-frequency information of the speech. And thus the naturalness and intelligibility of the communication speech cannot be ensured. Therefore, the two kinds of special acoustic microphones cannot be desirably used in a communication headphone in an environment of highly intense noises.

BRIEF SUMMARY OF THE INVENTION

In view of the aforesaid problems, an objective of the present invention is to provide a speech enhancing solution capable of effectively combining vibration microphones with the acoustic signal processing technology, to improve the SNR and the quality of a speech of a transmitter terminal in an environment of highly intense noises.

The present invention discloses a speech enhancing device, which comprises an acoustic speech enhancing unit and an electronic speech enhancing unit.

The acoustic speech enhancing unit comprises a primary vibration microphone and a secondary vibration microphone that have a specific relative positional relationship therebetween. The specific relative positional relationship allows the primary vibration microphone to pick up a user's speech signal transmitted through coupling vibration and an ambient noise signal transmitted through the air, and allows the secondary vibration microphone to mainly pick up an ambient noise signal transmitted through the air. The ambient noise signals transmitted through the air picked up by the primary vibration microphone and by the secondary vibration microphone are correlated with each other.

The electronic speech enhancing unit comprises a speech detecting module, an adaptive filtering module and a post-processing module.

The speech detecting module is configured to determine an updating speed of the adaptive filtering module and output a control parameter according to sound signals output by the primary vibration microphone and the secondary vibration microphone.

The adaptive filtering module is configured to denoise and filter the sound signal output by the primary vibration microphone according to the sound signal output by the secondary vibration microphone and the control parameter output by the speech detecting module, and output the denoised and filtered speech signal.

The post-processing module is configured to further denoise and perform speech high-frequency enhancement processing on the denoised and filtered speech signal output by the adaptive filtering module.

The present invention further discloses a denoising communication headphone, which comprises a speech signal transmitting port and the speech enhancing device as described above.

The speech signal transmitting port is configured to receive the speech signal denoised by the speech enhancing device and transmit the speech signal to a remote user.

The present invention further discloses a speech enhancing method, which comprises:

picking up a first sound signal and a second sound signal by using a primary vibration microphone and a secondary vibration microphone, respectively, that have a specific relative positional relationship therebetween, wherein the first sound signal comprises a user's speech signal transmitted through coupling vibration and an ambient noise signal transmitted through the air, the second sound signal is mainly an ambient noise signal transmitted through the air, and the ambient noise signal in the first sound signal and the ambient noise signal in the second sound signal are correlated with each other;

determining a control parameter, which is used to control an updating speed of an adaptive filter, according to the first sound signal and the second sound signal;

denoising and filtering the first sound signal according to the second sound signal and the control parameter, and outputting the denoised and filtered speech signal; and further denoising and performing speech high-frequency enhancement processing on the denoised and filtered speech signal.

As can be seen from the above descriptions, in the technical solutions of the present invention, the speech of the transmitter terminal is enhanced in an acoustic aspect and an electronic aspect, respectively. Specifically, in the acoustic aspect, a first sound signal that comprises a user's speech signal and an ambient noise signal and a second sound signal that is mainly an ambient noise signal are picked up by using a primary vibration microphone and a secondary vibration microphone, respectively, that have a specific relative positional relationship therebetween. Because the structure of the vibration microphones is adopted, ambient noises can be attenuated by 20 dB to 30 dB in the picking-up process. Moreover, the ambient noise in the first sound signal and the ambient noise in the second sound signal are highly correlated with each other, and this provides a desired noise reference signal for the electronic speech enhancing algorithm. In the electronic aspect, a control parameter used to control an updating speed of an adaptive filter is firstly determined according to the first sound signal and the second sound signal; then, the first sound signal is denoised and filtered according to the second sound signal and the control parameter, to obtain the speech signal with a high SNR; and finally, the denoised and filtered speech signal is further denoised and speech high-frequency enhancement is performed thereon. In this way, intelligibility and definition of the speech of the transmitter terminal can be improved significantly. As can be seen, a noise reduction amount as large as 40 dB to 50 dB can be finally achieved at the transmitter terminal of communication through the above-mentioned acoustic speech enhancement and electronic speech enhancement. This can significantly increase the SNR of the speech of the transmitter terminal in communication and desirably improve naturalness and intelligibility of the speech of the transmitter terminal. Thereby, the SNR and the quality of the speech in the environment of highly intense noises can be improved significantly.

BRIEF DESCRIPTION OF THE SEVERAL VIEWS OF THE DRAWINGS

In all the attached drawings, identical reference numbers denote similar or corresponding features or functions.

DETAILED DESCRIPTION OF THE INVENTION

Hereinbelow, embodiments of the present invention will be described in detail with reference to the attached drawings.

The speech enhancing method of the present invention comprises two parts. The first part is to enhance speech acoustically and provide for the electronic speech enhancing algorithm a primary signal of a desired signal to noise ratio (SNR) and a noise reference signal highly correlated with the primary signal. The second part is to further enhance the speech in the signal through acoustic signal processing to increase the SNR of the speech and improve intelligibility and comfortableness of the speech of the transmitter terminal. Hereinbelow, the technical solutions for enhancing speech in the acoustic aspect and in the electronic aspect will be elucidated, respectively.

In the acoustic aspect, the present invention adopts the structure of dual vibration microphones. The primary vibration microphone and the secondary vibration microphone are similar in structure and are disposed close to each other in the space, that is, the primary vibration microphone and the secondary vibration microphone have a specific relative positional relationship therebetween. The specific relative positional relationship allows the primary vibration microphone to pick up a user's speech signal transmitted through coupling vibration and an ambient noise signal transmitted through the air and allows the secondary vibration microphone to mainly pick up an ambient noise signal transmitted through the air. Moreover, the ambient noise signal transmitted into the primary vibration microphone and the ambient noise signal transmitted into the secondary vibration microphone respectively through the air are correlated with each other. Specifically, the primary vibration microphone makes direct contact with a headphone wearer and effectively picks up the headphone wearer's speech signal through coupling vibration; the secondary vibration microphone does not make direct contact with the headphone wearer and does not couple the speech signal transmitted through vibration. Both the primary vibration microphone and the secondary vibration microphone can attenuate the noise signals transmitted through the air by about 20 dB to 30 dB, and a desired correlation between the noise signal picked up by the primary vibration microphone and the noise signal picked up by the secondary vibration microphone can be ensured by adjustment of positions of the primary and secondary vibration microphones.

Figure 1:
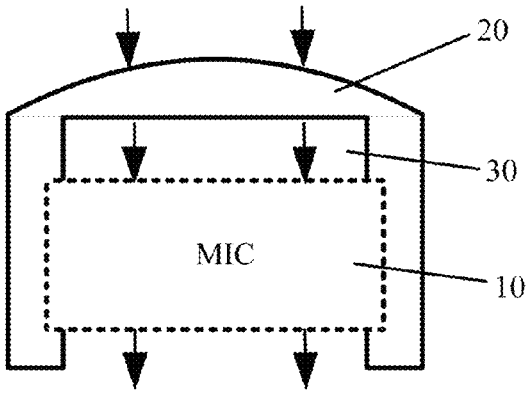
FIG. 1 is a schematic structural view illustrating a vibration microphone consisting of a microphone with a rubber sheath.

In an embodiment of the present invention, microphones each having an enclosed rubber sheath structure are used as the vibration microphones. FIG. 1 is a schematic structural view illustrating a vibration microphone consisting of a microphone disposed in an enclosed rubber sheath. As shown in FIG. 1, the microphone (MIC) 10 is disposed in the enclosed rubber sheath 20, and an enclosed air chamber 30 is kept between a diaphragm of the microphone 10 and the rubber sheath 20 to allow a sound signal to pass therethrough. Only after being attenuated by the rubber sheath 20 can ambient noises transmitted through the air be picked up by the diaphragm of the microphone 10, so the noises are reduced significantly. As to a vibration signal coupled on an upper surface of the rubber sheath 20, because vibration of a surface of the rubber sheath 20 will directly cause changes in volume of the enclosed air chamber 30 so as to cause vibration of the diaphragm of the microphone 10, the vibration signal coupled on an upper surface of the rubber sheath 20 can be effectively picked up by the microphone 10.

Figure 2:
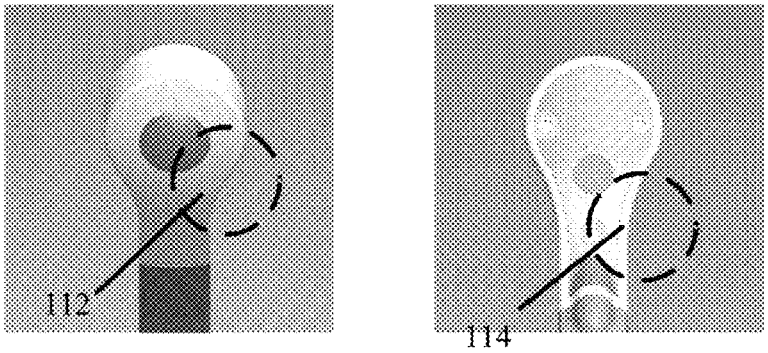
FIG. 2 is a schematic structural view illustrating a primary vibration microphone and a secondary vibration microphone assembled on a support in a speech enhancing device according to the present invention.
Figure 3A:
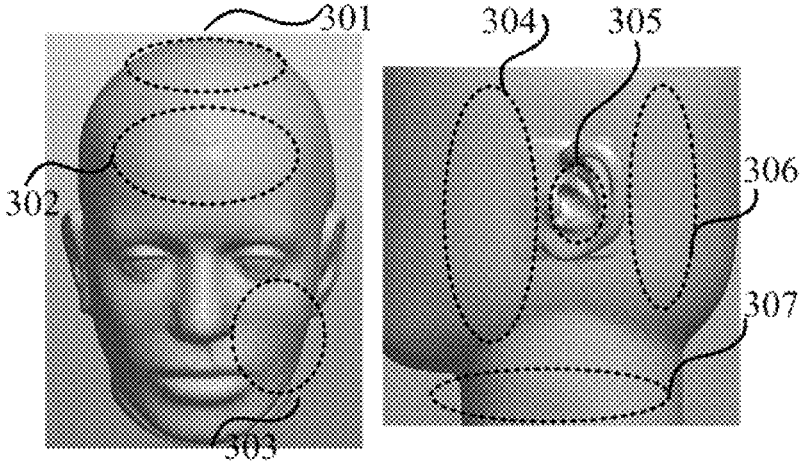
FIG. 3A is a schematic view illustrating positions at which the primary vibration microphone is coupled with a headphone wearer's head.
Figure 3B:
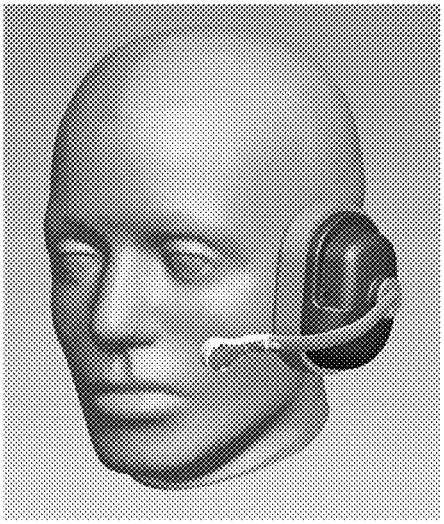
FIG. 3B is a schematic view illustrating a coupling status between the headphone having a microphone support according to the present invention and the wearer's cheek.

Additionally, at the same time of isolating the ambient noises, the microphone 10 having the rubber sheath 20 must effectively couple the headphone wearer's speech signal. Generally, when a person is speaking, many portions of the person's head contains a certain speech vibration signal (particularly low-frequency information), and especially speech frequency-spectrum information contained in vibrations at the larynx and the cheek is relatively abundant. Therefore, in consideration of convenience in use and aesthetics of the headphone, a microphone support as shown in FIG. 2 is designed in a preferred embodiment of the present invention, with a front surface and a back surface of a head portion of the support being each provided with one microphone having a rubber sheath. The microphones each having a rubber sheath are called a primary vibration microphone 112 and a secondary vibration microphone 114, respectively. The primary vibration microphone 112 is disposed on the surface close to the wearer's face, and the secondary vibration microphone 114 is disposed on the other surface opposite to the primary vibration microphone 112. The primary vibration microphone 112 and the headphone wearer's head may be coupled at many possible positions. FIG. 3A is a schematic view illustrating possible positions at which the primary vibration microphone is coupled with the head, and the possible positions include a top of head 301, a forehead 302, a cheek 303, a temple 304, inside of an ear 305, back of an ear 306, a larynx 307, and the like. A coupling status between the headphone provided with the microphone support and the wearer's cheek is as shown in FIG. 3B. A front surface of the rubber sheath of the primary vibration microphone 112 is well coupled with the headphone wearer's cheek, so the primary vibration microphone 112 can pick up the headphone wearer's speech information desirably. The secondary vibration microphone 114 does not make direct contact with the face and is thus insensitive to the headphone wearer's speech signal.

Moreover, using the rubber sheath structure as shown in FIG. 1 and using the support and the headphone wearing manner as shown in FIG. 2 and FIG. 3B can ensure that the primary vibration microphone 112 picks up a desired speech signal and an ambient noise signal that is attenuated by about 20 dB to 30 dB, and the secondary vibration microphone 114 mainly picks up an ambient noise signal attenuated by about 20 dB to 30 dB. The relatively pure ambient noise signal picked up by the secondary vibration microphone 114 can provide a desired ambient noise reference signal for the next denoising process in the electronic aspect. The primary vibration microphone 112 and the secondary vibration microphone 114 are disposed relatively close to each other in the space and have the similar rubber sheath structures. This can ensure a desired correlation between the ambient noise signals leaking into the two rubber sheaths so as to ensure that the noise signals can be further reduced in the electronic aspect.

Additionally, in order to prevent the secondary vibration microphone 114 from picking up too many vibration speech signals to damage the speech signal in the primary vibration microphone 112 in the electronic aspect, it is preferred to adopt a desirable vibration isolating measure between the primary vibration microphone 112 and the secondary vibration microphone 114. In a preferred embodiment of the present invention, some gaskets are additionally provided between the rubber sheaths of the primary vibration microphone and of the secondary vibration microphone for the purpose of vibration isolation.

After acoustic speech enhancement, the SNR of the signal in the primary vibration microphone 112 is increased by about 20 dB; however, this still cannot satisfy the requirements of communication in the cases of extreme noises. Therefore, in the present invention, the acoustic signal processing technology is adopted to further increase the SNR of the speech signal and improve naturalness and definition of the speech signal picked up through vibration.

It shall be noted that, the vibration microphones in the present invention are not limited to the aforesaid microphones each having an enclosed rubber sheath but may also be existing bone-conduction microphones, or common electret microphones (ECMs) that are additionally provided with a special acoustic structure design to achieve an effect similar to that of the vibration microphones. Hereinbelow, the present invention will be elucidated with respect to use of typical microphones plus the special acoustic structure design.

Figure 4:
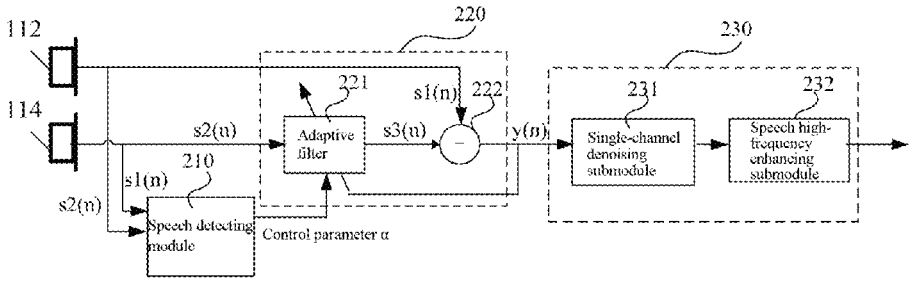
FIG. 4 is a block diagram of a system for electronic speech enhancement according to the present invention.

FIG. 4 is a block diagram of a system for electronic speech enhancement of the signal that has been subjected to the acoustic speech enhancement. As shown in FIG. 4, the electronic speech enhancing unit mainly comprises a speech detecting module 210, an adaptive filtering module 220 and a post-processing module 230. The speech detecting module 210 is configured to determine an updating speed of the adaptive filtering module 220 and output a control parameter $\alpha$ according to sound signals output by the primary vibration microphone 112 and by the secondary vibration microphone 114. The adaptive filtering module 220 is configured to denoise and filter the sound signal output by the primary vibration microphone 112 according to the sound signal output by the secondary vibration microphone 114 and the control parameter $\alpha$ output by the speech detecting module 210 and to output the denoised speech signal. The post-processing module 230 is configured to further denoise and perform speech high-frequency enhancement on the denoised and filtered speech signal output by the adaptive filtering module 220.

When a speech signal exists, the primary vibration microphone 112 directly couples vibration of the wearer's cheek to pick up a relatively strong speech signal. Although the secondary vibration microphone 114 is not directly coupled with the cheek, the secondary vibration microphone 114 is relatively close to the wearer's mouth, so when the wearer is speaking loudly, a speech signal leaking through air and picked up by the secondary vibration microphone 114 cannot be ignored. In this case, if the signal of the secondary vibration microphone 114 is directly used as a filtering reference signal for updating the adaptive filter and for filtering, then the speech may be damaged. As a result, the speech detecting module 210 must firstly determine an updating speed of the adaptive filter in the adaptive filtering module 220 according to the sound signals output by the primary vibration microphone 112 and by the secondary vibration microphone 114 and output the control parameter $\alpha$ used to control the updating speed of the adaptive filter 221.

In an embodiment of the present invention, the value of the control parameter $\alpha$ is determined by calculation of a statistic energy ratio P_ratio of the primary vibration microphone 112 to the secondary vibration microphone 114 within a low-frequency range. The larger the energy ratio P_ratio is, the larger the proportion of target speech existing in the sound signal picked up by the primary vibration microphone 112 will be, the smaller the value of the control parameter $\alpha$ will be, and the slower the updating speed of the adaptive filter will be. Conversely, the smaller the energy ratio P_ratio is, the smaller the proportion of target speech existing in the sound signal picked up by the primary vibration microphone 112 will be, the larger the proportion of ambient noises existing in the sound signal picked up by the primary vibration microphone 112 will be, the larger the value of the control parameter $\alpha$ will be, and the more rapid the updating speed of the adaptive filter 221 will be. The low-frequency range refers to a frequency range below 500 Hz. The control parameter $\alpha$ has a range of $0 \le \alpha \le 1$. In a preferred embodiment of the present invention, when the energy ratio P_ratio is set to be larger than 10 dB, it will be considered that the sound signal picked up by the primary vibration microphone 112 is completely the target speech signal, $\alpha=0$, and updating of the adaptive filter stops. When the energy ratio P_ratio is smaller than 0 dB, it will be considered that the sound signal picked up by the primary vibration microphone 112 is completely the ambient noise signal, $\alpha=1$, and the adaptive filter is updated at the highest speed.

The adaptive filtering module 220 comprises one adaptive filter 221 and one subtractor 222. In an embodiment of the present invention, an FIR filter having a step length P ($P \ge 1$) is used as the adaptive filter for the purpose of denoising and filtering, and the filter has a weight $\vec{w}$, $\vec{w}=[w(0), w(1), \ldots, w(P-1)]$. In this embodiment, P=64. The step length is mainly determined by a sampling frequency of the system and complexity of an acoustic propagation path between the primary vibration microphone and the secondary vibration microphone.

Suppose that the sound signals picked up and output by the primary vibration microphone 112 and by the secondary vibration microphone 114 are a first sound signal s1($n$) and a second sound signal s2($n$), respectively, and an input signal of the adaptive filter 221 is the sound signal s2($n$) picked up by the secondary vibration microphone 114. With the updating speed being controlled by the control parameter $\alpha$, the adaptive filter 221 filters an output signal s3($n$). The subtractor 222 subtracts the signal s3($n$) from the sound signal s1($n$) picked up by the primary vibration microphone 112 to obtain a signal y(n) in which the noises have been offset. The signal y(n) is fed back to the adaptive filter 221 to update the weight of the filter once again.

The updating speed of the adaptive filter 221 is controlled by the control parameter $\alpha$. When $\alpha=1$ (i.e., the sound signals s1($n$), s2($n$) only comprise noise components), the adaptive filter 221 rapidly converges to a transfer function H_noise of the noises from the secondary vibration microphone 114 to the primary vibration microphone 112, so that the signal s3($n$) and the signal s1($n$) are the same. And thus the signal y(n) in which the noises have been offset is particularly low, so the noises are eliminated. When $\alpha=0$ (i.e., the sound signals s1($n$), s2($n$) only comprise target speech components), updating of the adaptive filter stops, so the adaptive filter will not converge to a transfer function H_speech of the speech from the secondary vibration microphone 114 to the primary vibration microphone 112, and the signal s3($n$) is different from the signal s1($n$). Thus, the speech components after subtraction will not be offset, and the output signal y(n) has the speech components maintained therein. When $0<\alpha<1$ (i.e., the sound signal picked up by the primary vibration microphone 112 comprises both the speech components and the ambient noise components), the updating speed of the adaptive filter 221 is controlled by the amounts of the speech components and the ambient noise components to ensure that the speech components are maintained while the noises are eliminated.

Furthermore, the transfer function H_noise of the noises from the secondary vibration microphone 114 to the primary vibration microphone 112 and the transfer function H_speech of the speech from the secondary vibration microphone 114 to the primary vibration microphone 112 are similar to each other, so even though the adaptive filter 221 converges to the transfer function H_noise, the speech is still damaged to some extent. As a result, the control parameter $\alpha$ must be used to restrict the weight of the adaptive filter 221. In an embodiment of the present invention, the restriction is $\alpha*\vec{w}$. When $\alpha=1$ (i.e., the sound signal picked up by the primary vibration microphone 112 only comprises the ambient noise components), the adaptive filter 221 is not restricted and the ambient noises are all eliminated. When $\alpha=0$ (i.e., the sound signal picked up by the primary vibration microphone 112 only comprises the speech components), the adaptive filter 221 is completely restricted, and the speech is completely maintained. When $0<\alpha<1$ (i.e., the sound signal picked up by the primary vibration microphone 112 comprises both the speech components and the ambient noise components), the adaptive filter 221 is partially restricted, and the ambient noises are partially eliminated while the speech is completely maintained. In this way, the speech can be protected well while the noises are reduced.

It shall be noted that, although the noises are reduced by usage of the time-domain adaptive filter in the aforesaid embodiment, it shall be clear to those skilled in this art that the filter used in the filtering process is not limited to the time-domain adaptive filter and may also be a frequency-domain (subband) adaptive filter for noise reduction. Further, the control parameter $\alpha_i$ of each frequency subband can be obtained from a statistic energy ratio $P_ratio_i$ of the primary vibration microphone 112 to the secondary vibration microphone 114 within the frequency subband, and updating of the frequency-domain adaptive filter for each frequency subband is controlled independently. i is an index of the frequency subband. The larger the statistic energy ratio of each frequency subband is, the smaller the value of $\alpha_i$ corresponding to the frequency subband will be. $\alpha_i$ has a range of $0 \le \alpha_i \le 1$; that is, $\alpha_i$ ranges between 0 and 1.

In a preferred embodiment of the present invention, the post-processing module 230 comprises a single-channel denoising submodule 231 and a speech high-frequency enhancing submodule 232. The single-channel denoising submodule 231 firstly makes statistics on energy of stationary noises remaining in the signal y(n) output by the adaptive filtering module 220 according to stationary characteristics of the noises. In addition, because the speech signal picked up through vibration has relatively weak high-frequency energy, the speech has low definition and intelligibility after being processed. Therefore, the speech high-frequency enhancing submodule 232 is used to enhance high-frequency components in the speech signal that has been single-channel denoised by the single-channel denoising submodule 231. This can significantly improve definition and intelligibility of the output speech signal so that a sufficiently clear speech signal can be obtained by the user.

In an embodiment of the present invention, the single-channel denoising submodule 231 makes statistics on the energy of the noises through smoothed average and subtracts the energy of the noises from the signal y(n). Thereby, the noise components in the signal y(n) output by the adaptive filtering module 220 can be further reduced while the speech components in the signal y(n) are maintained, so as to increase the SNR of the speech signal.

Figure 5:
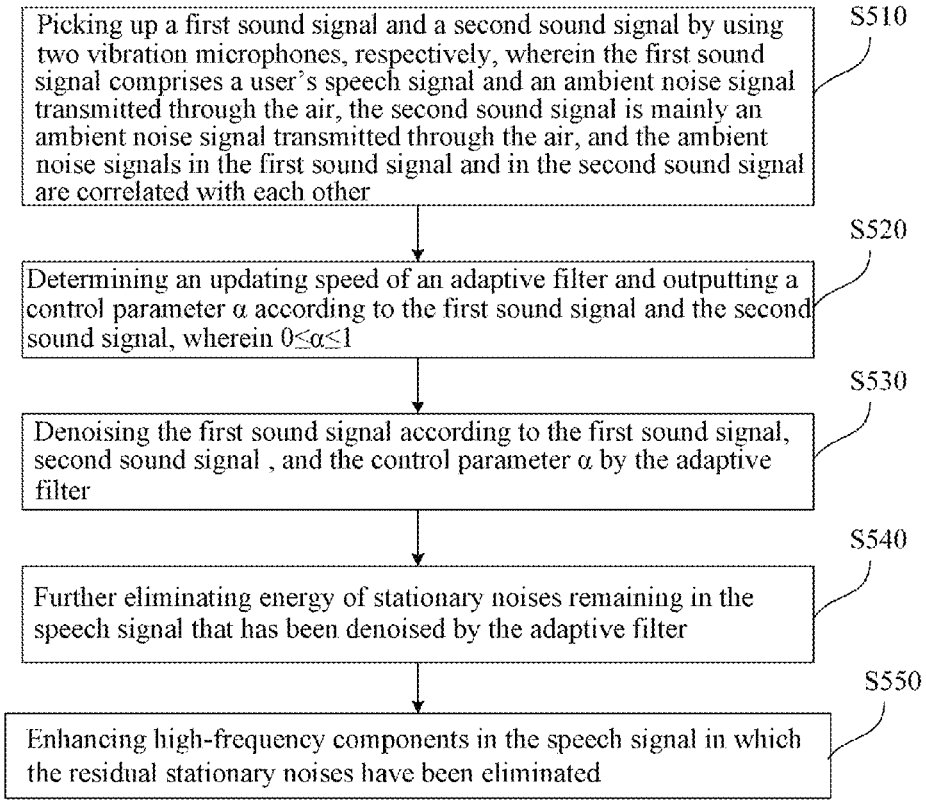
FIG. 5 is a schematic flowchart diagram of a speech enhancing method of the present invention.

In conjunction with the above descriptions about the technical solutions of the present invention, FIG. 5 is a schematic flowchart diagram of a speech enhancing method of the present invention. As shown in FIG. 5, the speech enhancing method of the present invention comprises the following steps:

firstly, in a step S510, picking up a first sound signal s1($n$) and a second sound signal s2($n$) by using a primary vibration microphone 112 and a secondary vibration microphone 114, respectively, wherein the first sound signal s1($n$) comprises a user's speech signal transmitted through coupling vibration and an ambient noise signal that leaks into a microphone from a rubber sheath, the second sound signal s2($n$) is mainly an ambient noise signal that leaks into the microphone from the rubber sheath, and the vibration microphones are disposed in such a way that the ambient noise signal in the first sound signal s1($n$) and that in the second sound signal s2($n$) are correlated with each other;

in a step S520, determining an updating speed of an adaptive filter and outputting a control parameter $\alpha$ according to the first sound signal s1($n$) and the second sound signal s2($n$), wherein $0 \leq \alpha \leq 1$;

in a step S530, denoising the first sound signal s1($n$) according to the first sound signal s1($n$), the second sound signal s2($n$) and the control parameter $\alpha$ by the adaptive filter;

in a step S540, further eliminating energy of stationary noises remaining in the speech signal that has been denoised by the adaptive filter; and finally, in a step S550, enhancing high-frequency components in the speech signal in which the energy of the remaining stationary noises has been eliminated.

The speech enhancing method of the present invention is implemented through software and hardware in combination.

Figure 6:
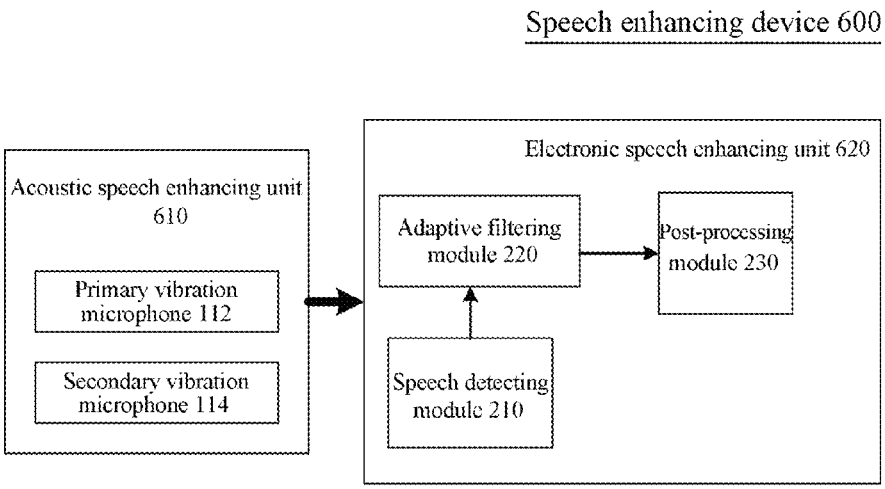
FIG. 6 is a block diagram of a speech enhancing device of the present invention.

FIG. 6 is a schematic view illustrating a logic structure of a speech enhancing device of the present invention that corresponds to the aforesaid speech enhancing method. As shown in FIG. 6, the speech enhancing device 600 of the present invention comprises an acoustic speech enhancing unit 610 and an electronic speech enhancing unit 620.

The acoustic speech enhancing unit 610 comprises a primary vibration microphone 112 and a secondary vibration microphone 114. The primary vibration microphone 112 is configured to pick up a user's speech signal transmitted through coupling vibration and an ambient noise signal transmitted through the air, and the secondary vibration microphone 114 is configured to pick up an ambient noise signal transmitted through the air. The ambient noise signals transmitted into the primary vibration microphone 112 and the secondary vibration microphone 114 respectively through the air are correlated with each other.

The electronic speech enhancing unit 620 comprises a speech detecting module 210, an adaptive filtering module 220 and a post-processing module 230. The speech detecting module 210 is configured to determine an updating speed of the adaptive filtering module 220 and output a control parameter $\alpha$ according to sound signals output by the primary vibration microphone 112 and by the secondary vibration microphone 114. The adaptive filtering module 220 is configured to denoise and filter the sound signal output by the primary vibration microphone 112 according to the sound signal output by the secondary vibration microphone 114 and the control parameter $\alpha$ output by the speech detecting module 210 and output the denoised and filtered speech signal. The post-processing module 230 is configured to further denoise and perform speech high-frequency enhancement on the denoised and filtered speech signal output by the adaptive filtering module 220.

Here, it shall be noted that:

when the adaptive filter 221 is a time-domain adaptive filter, the speech detecting module 210 is configured to determine the control parameter of the adaptive filter 221 by calculating a statistic energy ratio of the sound signal output by the primary vibration microphone 112 to the sound signal output by the secondary vibration microphone 114 within a low-frequency range, wherein the larger the statistic energy ratio is, the smaller the value of the control parameter will be, and the control parameter ranges between 0 and 1;

when the adaptive filter 221 is a frequency-domain adaptive filter, the speech detecting module 210 is configured to determine the control parameter $\alpha_i$ of each frequency subband by calculating a statistic energy ratio of the sound signal output by the primary vibration microphone 112 to the sound signal output by the secondary vibration microphone 114 within the frequency subband, wherein the larger the statistic energy ratio of the frequency subband is, the smaller the value of the control parameter $\alpha_i$ corresponding to the frequency subband will be, and the control parameter $\alpha_i$ corresponding to each frequency subband ranges between 0 and 1.

The operation flow of the components of the speech enhancing device 600 is completely identical to that described with reference to FIG. 4 and FIG. 5, and thus will not be further described herein.

Figure 7:
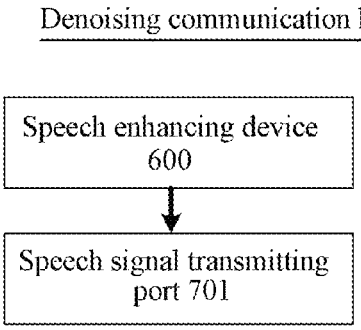
FIG. 7 is a block diagram of a denoising communication headphone of the present invention.

FIG. 7 is a block diagram of a denoising communication headphone 700 having a speech enhancing device according to the present invention.

As shown in FIG. 7, the denoising communication headphone 700 comprises a speech signal transmitting port 701 and the speech enhancing device 600 as shown in FIG. 6. The speech signal transmitting port 701 is configured to transmit a proximal speech signal to a remote user (i.e., to receive the speech signal denoised by the speech enhancing device 600 and then transmit the speech signal to the remote user in a wired way or a wireless way). The functions and descriptions of the components of the speech enhancing device 600 are completely identical to what have been described with reference to FIG. 4 and FIG. 6 and thus will not be further described herein.

According to the above descriptions, the present invention can eliminate ambient noises in the acoustic aspect and the electronic aspect to significantly improve the SNR and the quality of speech in an environment of highly intense noises for the following reasons.

1) Dual vibration microphones can effectively isolate ambient noises transmitted through the air. Because the primary vibration microphone and the secondary vibration microphone are similar in structure and are disposed close to each other in the space, the ambient noise signals leaking into the primary vibration microphone and the secondary vibration microphone are well correlated with each other.

2) For a useful speech signal generated when an headphone wearer speaks, because the primary vibration microphone is directly coupled with the wearer's head and is well isolated from the secondary vibration microphone, the primary vibration microphone can pick up the headphone wearer's vibration speech signal desirably while the secondary vibration microphone can only pick up a speech signal leaking therein.

3) A speech signal of a relatively high SNR and a relatively pure ambient noise reference signal are obtained through acoustic speech enhancement, and the SNR of the speech signal can be further increased by the adaptive noise eliminating technology and the single-channel speech enhancing technology in the electronic aspect.

4) High-frequency components in the speech signal that has been subjected to speech enhancement are enhanced in the electronic aspect, and this can significantly improve definition and intelligibility of the output speech signal so that a sufficiently clear speech signal can be obtained by the user.

5) As compared to a communication headphone that adopts a close-talking microphone as a transmitter, the present invention is insensitive to directionality and positions of noises, can reduce near-field and far-field noises of all directions by a stable amount and can also reduce wind noises desirably.

The speech enhancing method, the speech enhancing device and the denoising headphone according to the present invention have been illustrated as above with reference to the attached drawings. However, it shall be understood by those skilled in this art that, various modifications can further be made on the speech enhancing method, the speech enhancing device and the denoising headphone of the present invention without departing from the contents of the present invention. Therefore, the scope of the present invention shall be determined by the appended claims.

The invention claimed is:

1. A speech enhancing device, comprising an acoustic speech enhancing unit and an electronic speech enhancing unit, wherein, the acoustic speech enhancing unit comprises a primary vibration microphone and a secondary vibration microphone that have a specific relative positional relationship therebetween, the primary vibration microphone makes direct contact with a headphone wearer and effectively picks up the headphone wearer's speech signal through coupling vibration; the secondary vibration microphone does not make direct contact with the headphone wearer and does not couple the speech signal transmitted through coupling vibration; the specific relative positional relationship allows the primary vibration microphone to pick up a user's speech signal transmitted through coupling vibration and an ambient noise signal transmitted through the air and allows the secondary vibration microphone to mainly pick up an ambient noise signal transmitted through the air, and the ambient noise signals transmitted through the air that are picked up by the primary vibration microphone and by the secondary vibration microphone are correlated with each other;

the electronic speech enhancing unit comprises a speech detecting module, an adaptive filtering module and a post-processing module; wherein, the speech detecting module is configured to determine an updating speed of the adaptive filtering module and output a control parameter according to sound signals within a low-frequency range output by the primary vibration microphone and by the secondary vibration microphone; wherein the speech detecting module is configured to determine the control parameter by calculating a statistic energy ratio of the sound signal output by the primary vibration microphone to the sound signal output by the secondary vibration microphone within a low-frequency range, or the speech detecting module is configured to determine the control parameter of each frequency subband by calculating a statistic energy ratio of the sound signal output by the primary vibration microphone to the sound signal output by the secondary vibration microphone within the frequency subband;

the adaptive filtering module is configured to denoise and filter the sound signal output by the primary vibration microphone according to the sound signal output by the secondary vibration microphone and the control parameter output by the speech detecting module, and output the denoised and filtered speech signal; and the post-processing module is configured to further denoise and perform speech high-frequency enhancement on the denoised and filtered speech signal output by the adaptive filtering module.

2. The device of claim 1, wherein, the primary vibration microphone consists of a microphone disposed in an enclosed rubber sheath, and an enclosed air chamber is disposed between a diaphragm of the microphone and the rubber sheath; and the secondary vibration microphone has the same structure as the primary vibration microphone.

3. The device of claim 1, wherein, the primary vibration microphone and the secondary vibration microphone are disposed on a front surface and a back surface of a microphone support, respectively, and a vibration isolating structure is disposed between the primary vibration microphone and the secondary vibration microphone.

4. The device of claim 1, wherein the post-processing module comprises:

a single-channel denoising submodule configured to make statistics on energy of stationary noises remaining in the denoised and filtered speech signal output by the adaptive filtering module and to subtract the energy of the stationary noises from the denoised and filtered speech signal output by the adaptive filtering module to obtain a speech signal, and then to output the speech signal to a speech high-frequency enhancing submodule; and the speech high-frequency enhancing submodule configured to enhance high-frequency components in the speech signal that has been denoised by the single-channel denoising submodule.

5. The device of claim 1, wherein, the larger the statistic energy ratio is, the smaller the value of the control parameter will be, and the control parameter ranges between 0 and 1;

the larger the statistic energy ratio of the frequency subband is, the smaller the value of the control parameter corresponding to the frequency subband will be, and the control parameter corresponding to each frequency subband ranges between 0 and 1.

6. The device of claim 1, wherein the adaptive filtering module comprises an adaptive filter and a subtractor, wherein, the adaptive filter is configured to filter the sound signal output by the secondary vibration microphone under the control of the control parameter, and output the filtered sound signal to the subtractor; and the subtractor is configured to subtract the signal output by the adaptive filter from the sound signal output by the primary vibration microphone to output the denoised and filtered speech signal and feed the denoised and filtered speech signal back to the adaptive filter.

7. A denoising communication headphone, comprising a speech signal transmitting port and the speech enhancing device of any one of claim 1 to claim 6, wherein, the speech signal transmitting port is configured to receive the speech signal denoised by the speech enhancing device and transmit the speech signal to a remote user.

8. A speech enhancing method, comprising:

picking up a first sound signal and a second sound signal by using a primary vibration microphone and a secondary vibration microphone, respectively, that have a specific relative positional relationship therebetween, the primary vibration microphone makes direct contact with a headphone wearer and effectively picks up the headphone wearer's speech signal through coupling vibration; the secondary vibration microphone does not make direct contact with the headphone wearer and does not couple the speech signal transmitted through coupling vibration; wherein the first sound signal comprises a user's speech signal transmitted through coupling vibration and an ambient noise signal transmitted through the air, the second sound signal is mainly an ambient noise signal transmitted through the air, and the ambient noise signals in the first sound signal and in the second sound signal are correlated with each other;

determining a control parameter, which is used to control an updating speed of an adaptive filter, according to the first sound signal and the second sound signal within a low-frequency range; wherein determining the control parameter by calculating a statistic energy ratio of the first sound signal to the second sound signal within a low-frequency range, or determining the control parameter of each frequency subband by calculating a statistic energy ratio of the first sound signal to the second sound signal within the frequency subband;

denoising and filtering the first sound signal according to the second sound signal and the control parameter, and outputting the denoised and filtered speech signal; and further denoising and performing speech high-frequency enhancement on the denoised and filtered speech signal.

9. The method of claim 8, wherein the step of further denoising and performing speech high-frequency enhancement on the denoised and filtered speech signal comprises:

making statistics on energy of stationary noises remaining in the denoised and filtered speech signal, subtracting the energy of the stationary noises from the denoised and filtered speech signal, and then enhancing high-frequency components.

10. The method of claim 8 or claim 9, wherein, the larger the statistic energy ratio is, the smaller the value of the control parameter will be, and the control parameter ranges between 0 and 1;

the larger the statistic energy ratio of the frequency subband is, the smaller the value of the control parameter corresponding to the frequency subband will be, and the control parameter corresponding to each frequency subband ranges between 0 and 1.

* * * * *